United States Patent [19]

Strawder

[11] Patent Number: 5,050,755

[45] Date of Patent: Sep. 24, 1991

[54] MODULAR RECEPTACLES SUCH AS TRASH CANS

[76] Inventor: Glenn G. Strawder, 9200 Edwards Way, #1116, Adelphi, Md. 20783

[21] Appl. No.: 501,950

[22] Filed: Mar. 28, 1990

[51] Int. Cl.[5] ..... B65D 25/22

[52] U.S. Cl. ..... 320/23.4; 220/23.83; 220/254; 220/334; 220/352; 220/909

[58] Field of Search ..... 220/909, 23.2, 23.4, 220/524, 23.83, 352, 254, 334

[56] References Cited

U.S. PATENT DOCUMENTS

| | | | |
|---|---|---|---|
| 3,194,426 | 7/1965 | Brown, Jr. | 220/23.4 |
| 3,632,038 | 1/1972 | Souza | 229/37 |
| 3,749,273 | 7/1973 | Wreghitt et al. . | |
| 3,763,980 | 10/1973 | Vom Stein et al. | 220/23.4 X |
| 4,410,095 | 10/1983 | Dembicks . | |
| 4,624,383 | 11/1986 | Moore | 220/23.4 |
| 4,708,253 | 11/1987 | Mednis . | |
| 4,770,297 | 9/1988 | Chang . | |
| 4,886,239 | 12/1989 | Stimmel | 249/117 |
| 4,889,254 | 12/1989 | Vola | 220/23.4 |

FOREIGN PATENT DOCUMENTS

| | | | |
|---|---|---|---|
| 2151359 | 4/1973 | Fed. Rep. of Germany | 220/23.4 |
| 2729285 | 1/1979 | Fed. Rep. of Germany | 220/23.4 |
| 2276236 | 1/1976 | France | 220/23.4 |

*Primary Examiner*—Stephen Marcus
*Assistant Examiner*—Stephen K. Cronin
*Attorney, Agent, or Firm*—William D. Hall

[57] ABSTRACT

A plurality of receptacles, each having a bottom, and each having a sidewall that terminates at a rim. Each receptacle also has a side that has a projection, and at least one side that defines an indent. The indented sidewall of one receptacle will receive the projection on the other receptacle, interconnecting them. Each receptacle handle projects into a slot in another receptacle when the receptacles are interconnected with each other. Tops or lids with the same configuration as the receptacle, cover the top area.

7 Claims, 3 Drawing Sheets

MODULAR RECEPTACLES SUCH AS TRASH CANS

BACKGROUND OF THE INVENTION

Trash cans for segregating waste products are well known. It is known to have modular units that fit together with each unit receiving a different kind of trash.

SUMMARY OF THE INVENTION

My invention provides a new type of trash receptacle for separating, collecting and storing waste products for recycling. The receptacle is simple to make and use. Several receptacles are interconnected together to create a simple and convenient system for recycling waste products.

The invention employs one or more receptacles of the same configuration interconnecting with each other through the usage of a tongue and groove joint. In other words one receptacle has a projection that enters an indent (or alternatively a hole) in the other receptacle. The protruding side wall of one receptacle fits into the indents in the side wall of another receptacle. This locates and secures them together.

A handle projects from the sidewall of the receptacle. The handle fits into a slot in the sidewall of another receptacle. This tends to lock the receptacles together and to stabilize their positions during use. The handle is also used for carrying and dumping the receptacle.

Preferably, two or more similar receptacles are involved, and each receptacle is adapted to mate with a similar receptacle. Since there is often more trash of one category than of another category, some of the receptacles are larger than others. But they all preferably have the property of mating with the others. To effect this, when the tongue and groove joint of two receptacles mate, the handle of one receptacle enters a slot of the other receptacle. With my invention the modules are not firmly attached to each other but are held together without the need for special parts intended for that purpose alone.

DETAILED DESCRIPTION OF THE INVENTION

Figure 1:
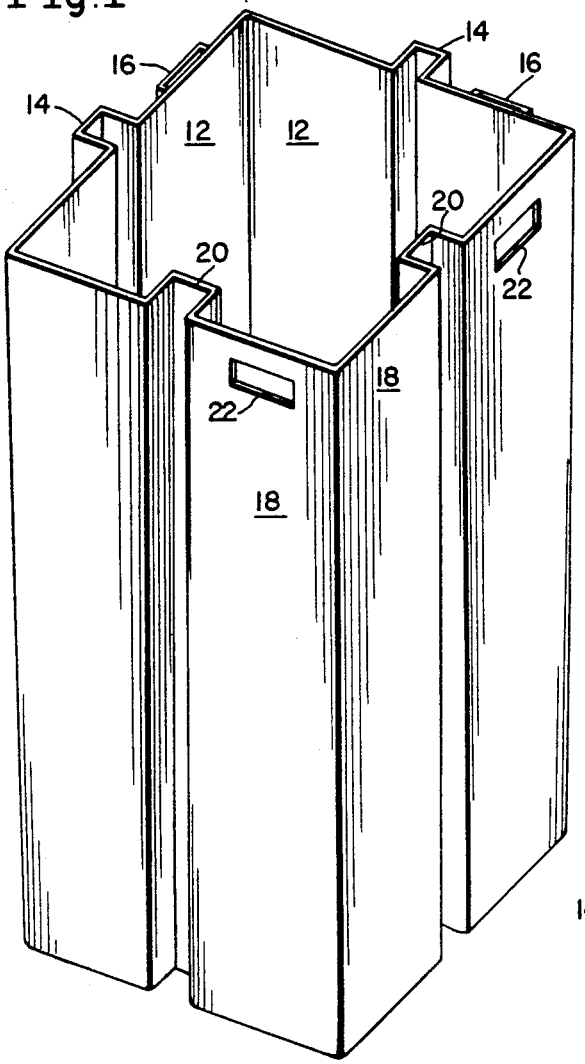
FIG. 1 is a perspective view of the receptacle of the invention.
Figure 2:
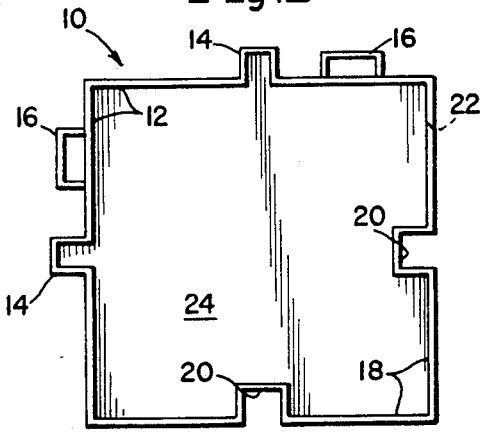
FIG. 2 is a top plan view of the receptacle of FIG. 1.
Figure 6:
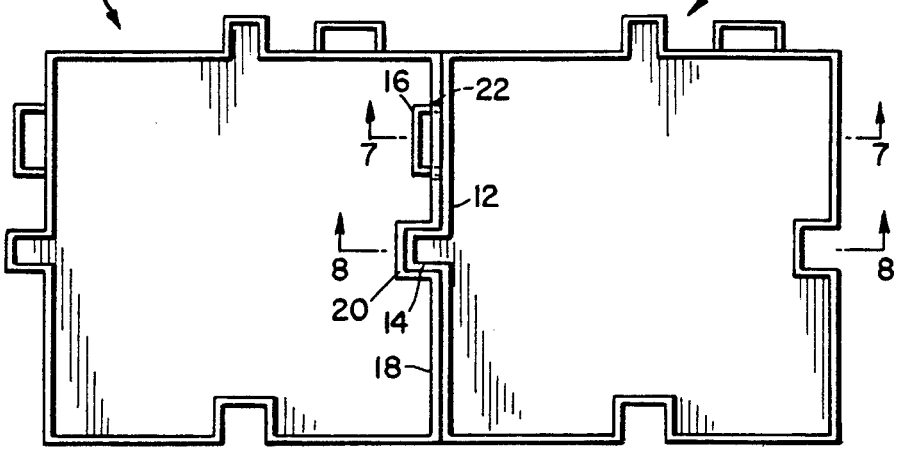
FIG. 6 is a plan view of two receptacles mating together.
Figure 8:
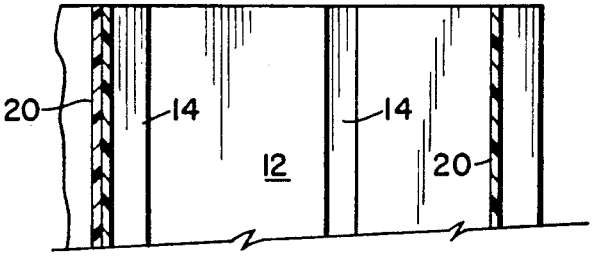
FIG. 8 is a fragmentary cross-section taken along line 8—8 of FIG. 6.

In the preferred form of the invention as shown in FIG. 1, a receptacle 10 has a bottom resting on the ground and a sidewall 12, 18 terminating at its upper end in a rim. The sidewall 12, 18 constitutes a body portion. Sidewall 12 has a first male portion in the form of a vertical protrusion 14 extending from the rim of sidewall 12 downward, to the bottom of receptacle 10. Sidewall 18 has a first female portion in the form of a vertical indent 20 extending from the rim of side 18 downward to the bottom of receptacle 10. FIGS. 6 and 8 show two receptacles interconnected by the tongue and groove joint 14, 20. The entire vertical protrusion 14 mates with the entire vertical indent or space 20 of side 18. FIGS. 1 and 2 show a receptacle 10 with more than one vertical protrusion 14, which allows more receptacles 10 to be interconnected to the receptacle.

Figure 7:
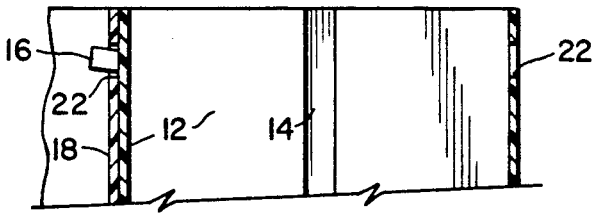
FIG. 7 is a fragmentary cross-section taken along line 7—7 of FIG. 6.
Figure 10:
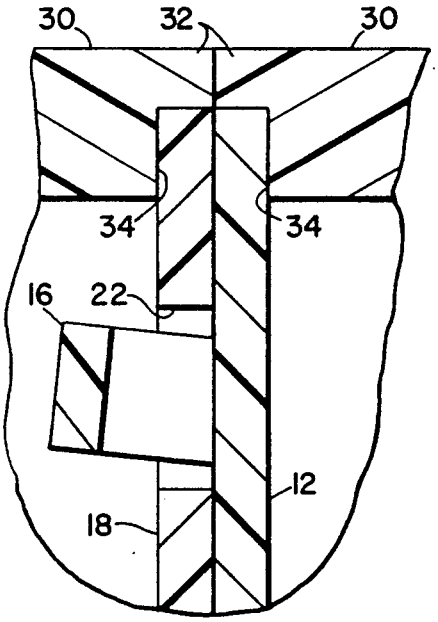
FIG. 10 is an enlarged fragmentary cross-section taken along line 10—10 of FIG. 9.

In FIGS. 1 and 2, handles 16 are located on the outer surface of side 12, extending outward beneath the rim. Handle 16 is a second male portion and is located adjacent of the vertical protrusion 14. FIGS. 6, 7, and 10 illustrate how handle 16 mates, when two receptacles 10 interconnect. Handle 16 projects into an open slot 22 in the side 18 with the vertical indent 20, adding more stability to the interconnected receptacles 10. The open slot 22 is a second female portion.

The slot 22 is located adjacent of the vertical indent 20, in side 18, for receiving the handle 16 of another receptacle 10, when interconnected as shown in FIGS. 6, 7, and 10.

Figure 3:
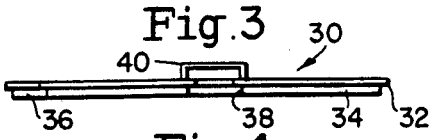
FIG. 3 is a side elevation of a top or lid for the receptacle of FIG. 1.
Figure 4:
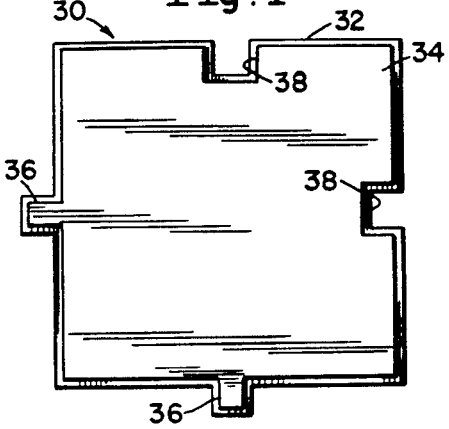
FIG. 4 is a bottom view of the lid for the receptacle of FIG. 1.
Figure 9:
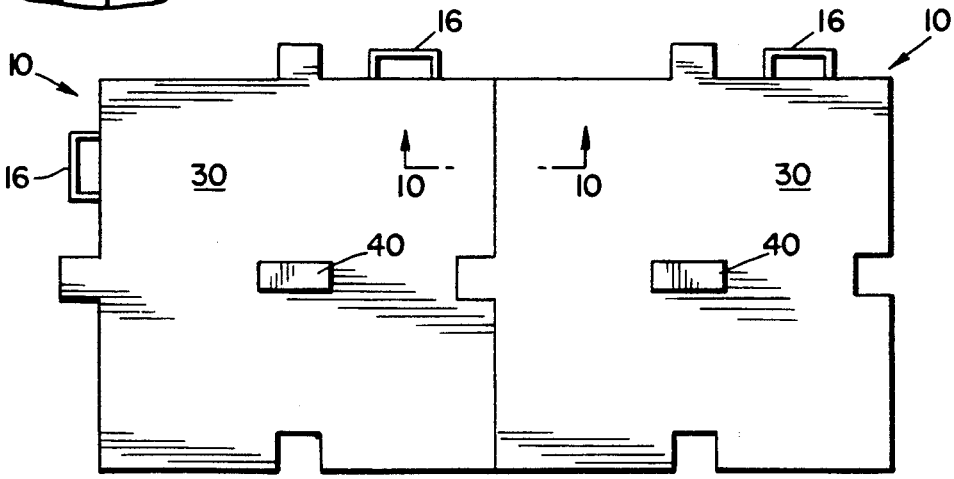
FIG. 9 is plan view similar to FIG. 6 with the lids on the receptacle.

A cover 30 is shown in FIGS. 3 and 4 having a handle 40, lid edge portion 32, a bottom protruding surface 34 and protrusions 36 and indents 38 complementary to the shape of the receptacle 10 it covers. FIG. 9 is FIG. 6 with two (2) covers 30 in place. FIG. 10 shows two (2) covers 30 mating with each other and with sidewall 12, 18.

Figure 12:
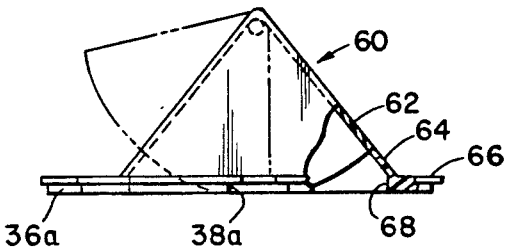
FIG. 12 is a side view of a lid of FIG. 11, partially in section.

FIG. 12 illustrates a swinging door type cover 60, with a door frame 64, swinging door 62, a lid portion 66 of the cover 60, and an opening in cover 60 forming the mouth 68 of a receptacle 10 when in place.

Figure 5:
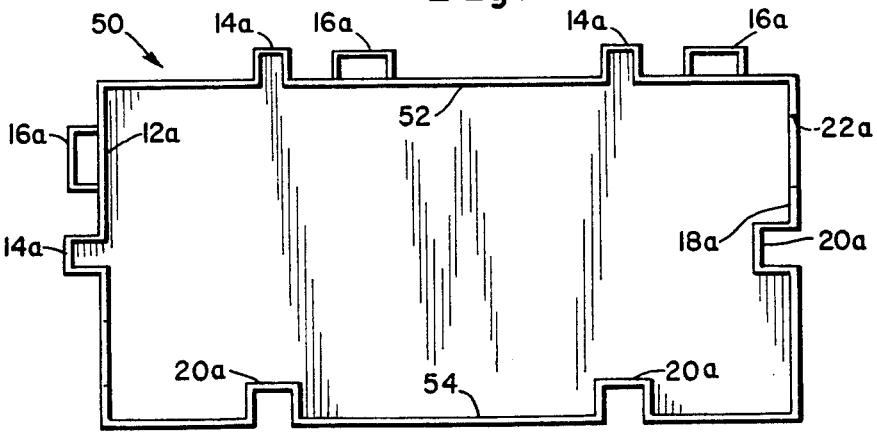
FIG. 5 is a plan view of a double sized receptacle according to the invention.

In FIG. 5 a double-size receptacle 50 is shown without a cover. Receptacle 50 has a plurality of vertical protrusions 14*a*, vertical indents 20*a*, handles 16*a* and an open slot 22*a*.

Figure 11:
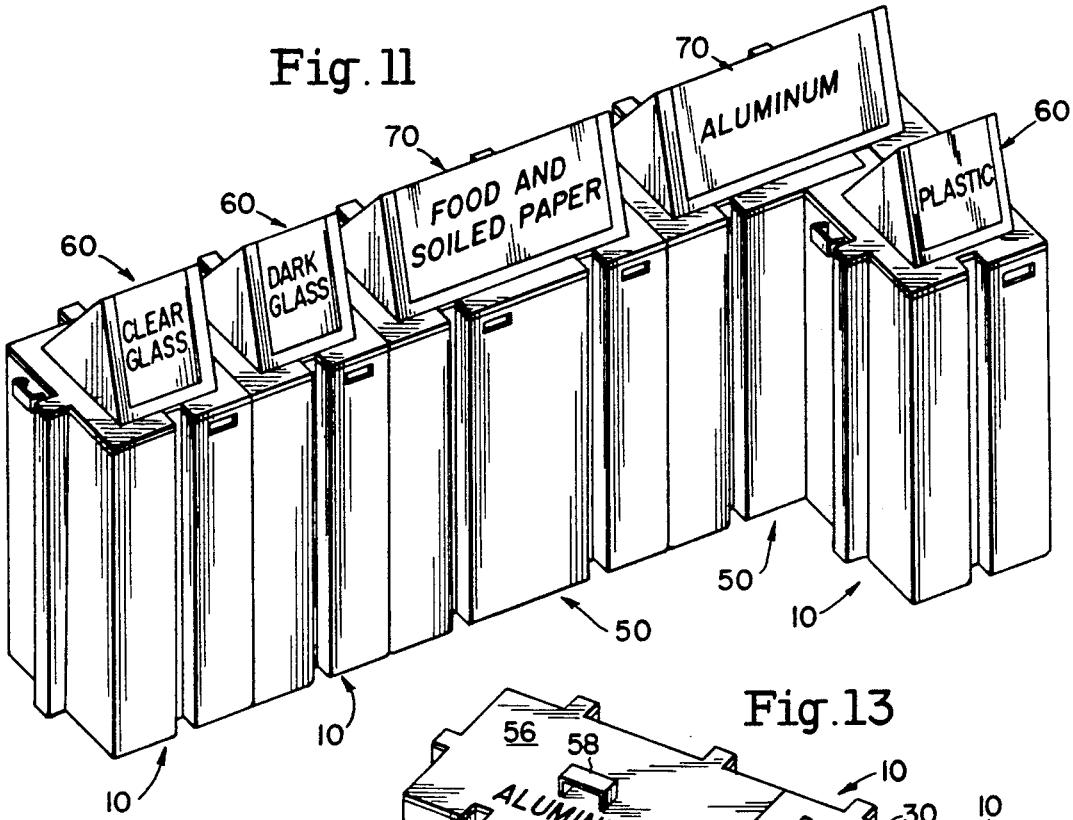
FIG. 11 is a perspective view of the receptacle system shown interlocked using "swing" type tops.
Figure 13:
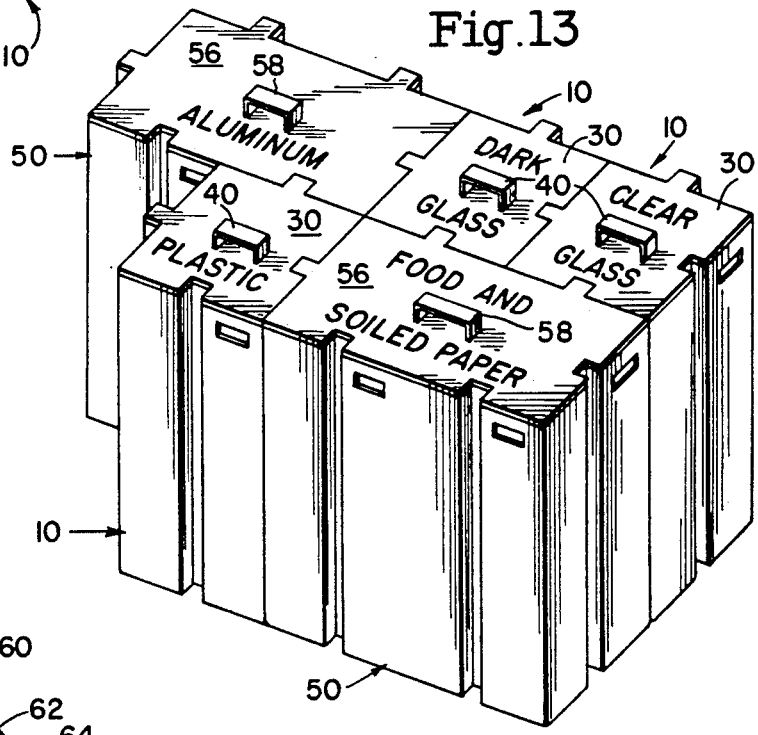
FIG. 13 is a perspective view of the receptacle system utilizing flat lids as seen in FIGS. 3 and 9.

FIGS. 11 and 13 show how a plurality of receptacles 10 and 50 can interconnect with each other.

A cover (top or lid) can be used with either of FIGS. 11 or 13. Each cover or lid conforms to the opening of the receptacle it will cover.

Each receptacle and/or cover is labeled to receive a particular type of solid waste material.

In this specification I use the word "sidewall" to include all four sides of the receptacles shown. In the case of a round receptacle the word "sidewall" would extend clear around the receptacle. Each receptacle shown in the drawing has four sides, but any other number of sides is contemplated.

I claim to have invented:

1. A receptacle capable of mating with a similar receptacle, comprising:

a body portion for receiving products placed in the receptacle, said body portion having a first male portion and a first female portion, said first male portion and said first female portion being so positioned that when said receptacle mates with another receptacle having male and female portions similar to those on said body portion, said first male portion will mate with the first female portion of said another receptacle to position the receptacles in a desired relative position to each other, said body portion having a second male portion and a second female portion each positioned so that when said first named receptacle and said another receptacle mate with each other the second male portion of one of the receptacles will mate with the second female portion of the other receptacle, said second male portion comprising a handle, said body member having a wall, said wall defining an opening extending through the wall, said opening constituting said second female portion, said mating of said first-named receptacle with said another receptacle including said handle of said first-named receptacle projecting through said opening in said another receptacle.

2. A receptacle as defined in claim 1 in which said first male portion of the receptacle and said first female portion of said similar receptacle have such a close fit to each other as to stabilize the positions of the two mating receptacles.

3. A receptacle as defined in claim 1 in which said second male portion of the receptacle and said second female portion of the similar receptacle make such a close fit as to stabilize the relative positions of the receptacles.

4. A receptacle as defined in claim 3 in which said firs ma portion of said receptacle makes such a close fit with said first female portion of said similar receptacle as to stabilize the relative positions of said receptacles.

5. A receptacle as defined in claim 1 in which said first male portion projects away from said body portion.

6. A receptacle as defined in claim 1, in which said first male portion projects outwardly from and away from said body portion.

7. A receptacle, comprising:

first and second receptacles, each having a bottom for resting on a horizontal surface and a sidewall extending upwardly, said first receptacle having a projection extending outwardly from its sidewall and said second receptacle defining a space for receiving said projection, one of said sidewalls having a handle projecting outwardly therefrom and the other of said sidewalls defining an opening for said handle to project therethrough.

* * * * *